US008277116B2

(12) United States Patent
Winkler et al.

(10) Patent No.: US 8,277,116 B2
(45) Date of Patent: Oct. 2, 2012

(54) FLUIDIC MIXER WITH CONTROLLABLE MIXING

(75) Inventors: Chad M. Winkler, Glen Cargon, IL (US); Matthew J. Wright, Kirkwood, MO (US); Mori Mani, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 1347 days.

(21) Appl. No.: 11/745,363

(22) Filed: May 7, 2007

(65) Prior Publication Data

US 2008/0279041 A1 Nov. 13, 2008

(51) Int. Cl.
*B01F 5/06* (2006.01)

(52) U.S. Cl. ..... 366/336; 138/45

(58) Field of Classification Search ..... 366/337, 366/336, 338, 167.1, 174.1, 175.2, 183.2; 138/45, 46

See application file for complete search history.

(56) References Cited

U.S. PATENT DOCUMENTS 2,117,944 A * 5/1938 Cochrane ..... 48/180.1
2,307,273 A * 1/1943 Hughes ..... 251/212
2,361,150 A * 10/1944 Petroe ..... 162/66
2,649,272 A * 8/1953 Barbato ..... 251/212
2,735,664 A * 2/1956 Gamble ..... 261/23.1
2,918,933 A * 12/1959 Boitnott ..... 137/502
2,934,892 A * 5/1960 Hurlbert et al. ..... 239/265.39
2,968,919 A * 1/1961 Hughes et al. ..... 239/265.37
4,079,718 A * 3/1978 Holzbaur ..... 123/452
4,094,492 A * 6/1978 Beeman et al. ..... 251/212
4,180,041 A * 12/1979 Miyazaki et al. ..... 123/590
4,228,772 A * 10/1980 Bakonyi ..... 123/403
4,398,511 A * 8/1983 Nemazi ..... 123/188.14
4,459,922 A * 7/1984 Chadshay ..... 110/265
4,577,602 A * 3/1986 Showalter ..... 123/306
5,370,578 A * 12/1994 Yi ..... 454/305
5,829,464 A * 11/1998 Aalto et al. ..... 137/1
6,443,609 B2 * 9/2002 Short ..... 366/152.1
6,606,975 B1 * 8/2003 Caliskan et al. ..... 123/306
6,751,944 B2 * 6/2004 Lair ..... 60/226.3
6,779,786 B2 * 8/2004 Ruscheweyh et al. ..... 261/79.2

OTHER PUBLICATIONS

U.S. Appl. No. 11/551,369, filed Oct. 20, 2006, Winkler, 27 pgs.

* cited by examiner

*Primary Examiner* — Tony G Soohoo
(74) *Attorney, Agent, or Firm* — Klintworth & Rozenblatt IP LLC

(57) ABSTRACT

In one embodiment of the disclosure, a fluid mixing device comprises a flow duct, with a wall having an inner surface defining a fluid flow path for a primary flow, and at least one deployable and retractable projection. The projection is adapted to controllably generate at least one secondary flow adjacent the inner surface. In other embodiments, methods are provided of controllably mixing at least one fluid within a fluid mixing device.

27 Claims, 10 Drawing Sheets

FLUIDIC MIXER WITH CONTROLLABLE MIXING

BACKGROUND

A variety of mixing devices, and methods of use, exist today for mixing one or more fluids. For instance, one existing mixing device utilizes turning of the flow at bends to mix fluids. Another mixing device utilizes fixed-in-place obstructions on the walls to induce mixing. Yet another mixing device utilizes pulsing of the flow to cause instabilities which lead to mixing. However, many of these devices have a lack of control over the mixing rates, and/or other type of problem.

A mixing device, and/or method of controllably mixing at least one fluid within a fluid mixing device, is needed to decrease one or more problems associated with one or more of the existing mixing devices and/or methods.

SUMMARY

In one aspect of the disclosure, a fluid mixing device comprises a flow duct comprising a wall having an inner surface, and at least one deployable and retractable projection for controllably generating at least one secondary flow adjacent the inner surface. The inner surface defines a fluid flow path for a primary flow within the flow duct.

In another aspect of the disclosure, a method is provided for controllably mixing at least one fluid within a fluid mixing device. In one step, a fluid mixing device is provided comprising a duct and at least one deployable and retractable projection. In another step, a primary flow of least one fluid is formed within the duct. In still another step, the at least one deployable and retractable projection is deployed to form at least one secondary flow within the duct in order to controllably mix the at least one fluid within the duct.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
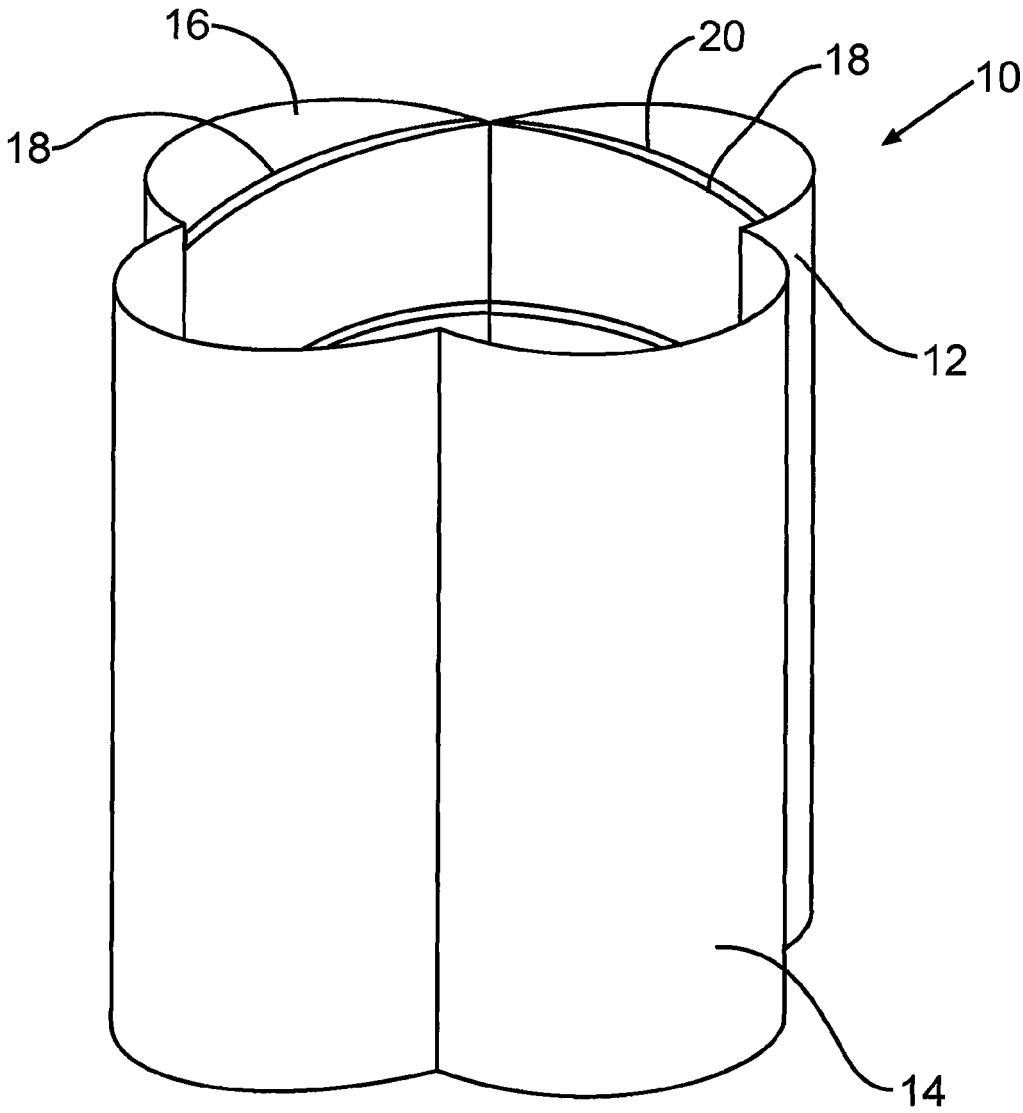
FIG. 1 shows a perspective view of one embodiment of a fluid mixing device.
Figure 2:
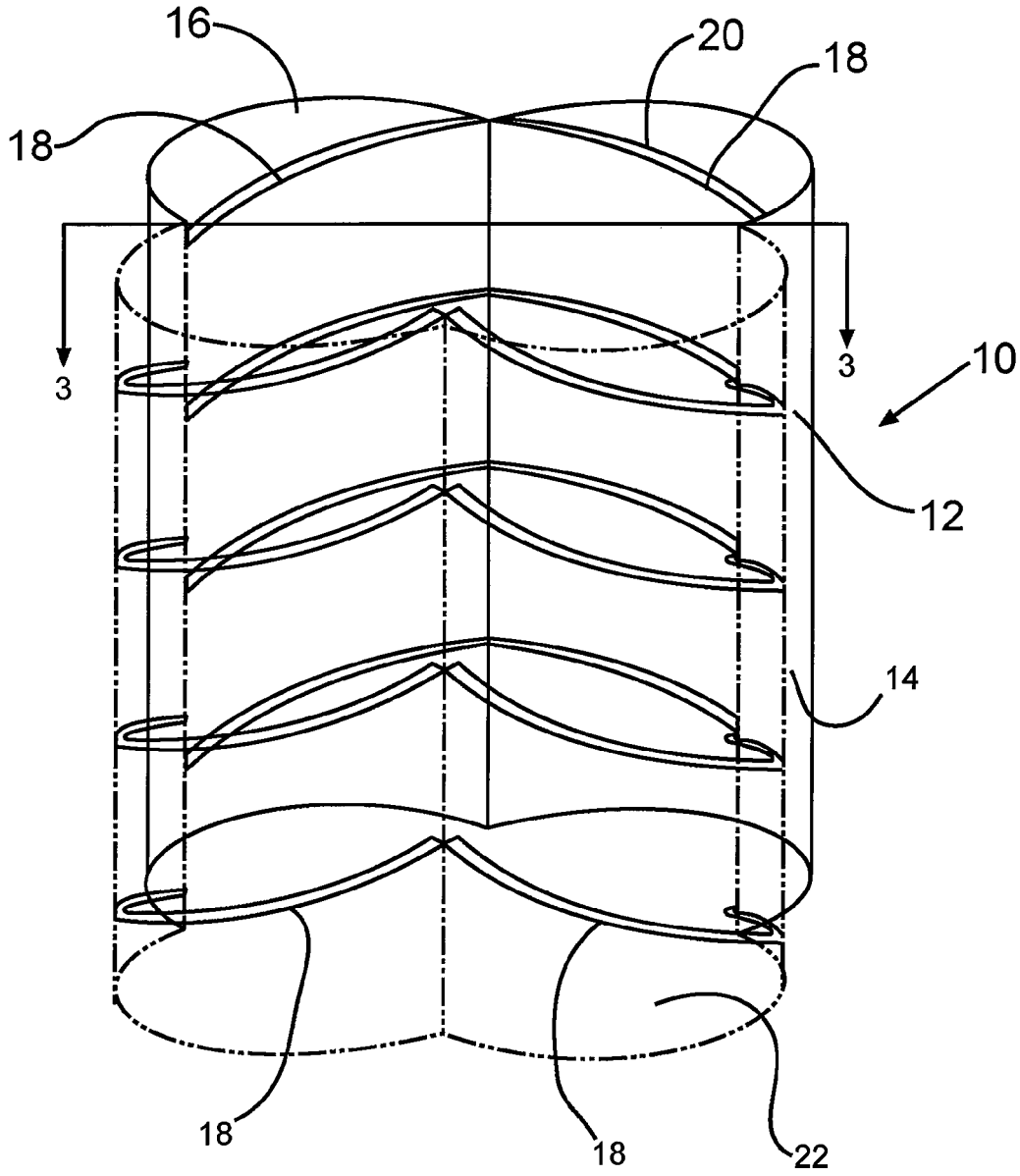
FIG. 2 shows a perspective view of the fluid mixing device of FIG. 1 with a portion of a wall of a flow duct made transparent.

FIG. 1 shows a perspective view of one embodiment of a fluid mixing device 10, which may comprise a portion of an engine, a portion of a combustion device, a portion of a pharmaceutical device, and/or other type of mixing device. The fluid mixing device 10 comprises a clover-leaf-shaped flow duct 12, having a wall 14 with an inner surface 16, and a plurality of helical deployable and retractable projections 18 which are adapted to be retracted into and deployed out of gaps 20 in the inner surface 16 of the wall 14 of the flow duct 12. The projections 18 may comprise vanes extending in helical paths. In other embodiments, the flow duct 12 and the projections 18 may be varied in number, shape, size, orientation, and configuration. For instance, in one embodiment, only one projection 18 of any shape or size may be used within a flow duct 12 of any shape or size. In another embodiment, at least one projection 18 of any shape or size may be used within a flow duct 12 of any shape or size. FIG. 2 shows a perspective view of the fluid mixing device 10 of FIG. 1 with a portion 22 of the wall 14 of the flow duct 12 made transparent in order to be able to view the helical alignment of the deployable and retractable projections 18 which are axially spaced and extend around the interior circumference of the inner surface 16 of the flow duct 12. In other embodiments, any number of deployable and retractable projections 18 may be utilized in varying configurations, locations, and orientations.

Figure 3:
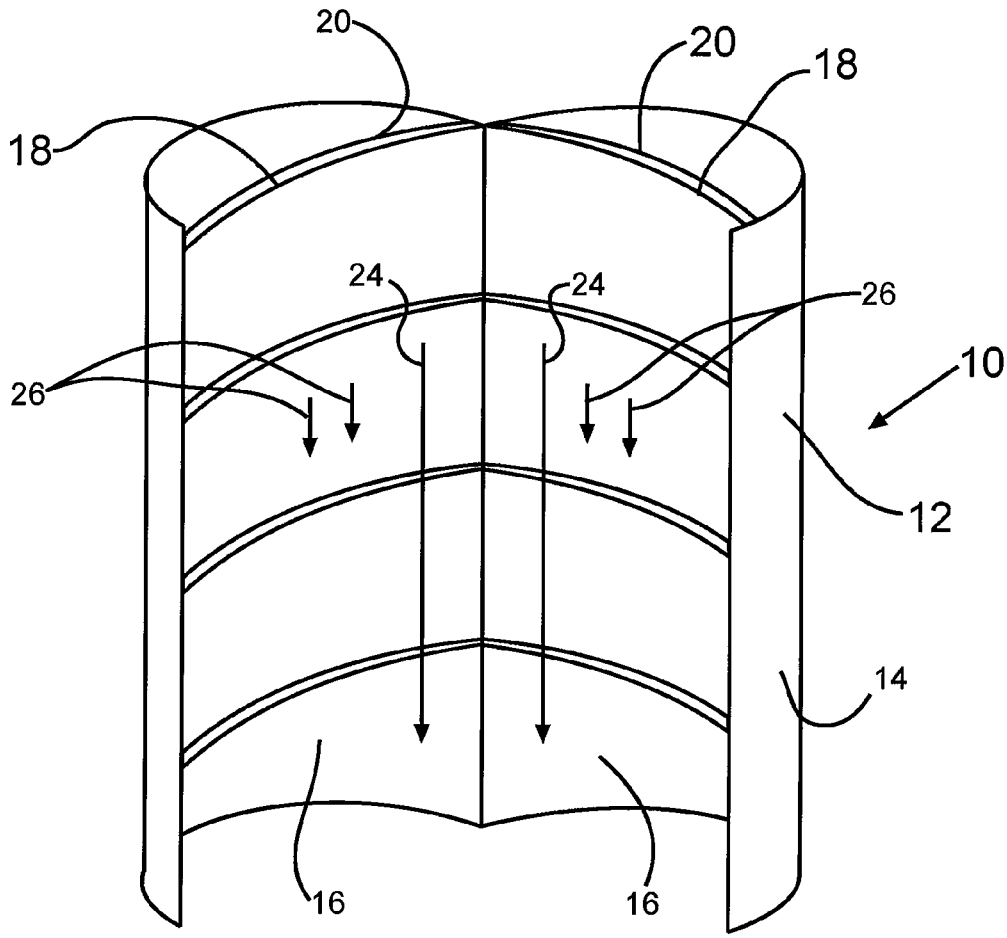
FIG. 3 shows a cross-section view along line 3-3 of FIG. 2.
Figure 4:
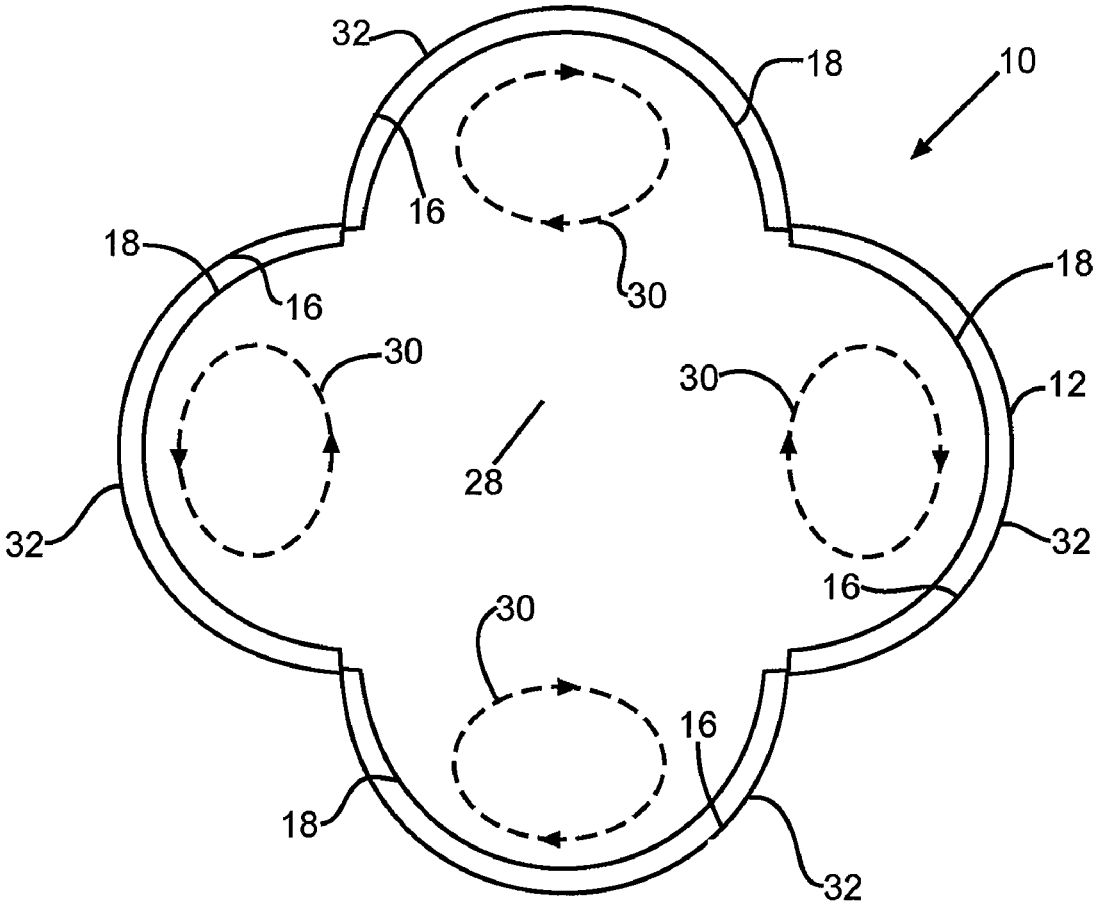
FIG. 4 shows a top view of the fluid mixing device of FIG. 1 with deployable and retractable projections in deployed positions.

FIG. 3 shows a cross-section view along line 3-3 of FIG. 2. As shown in FIG. 3, the inner surface 16 of the flow duct 12 defines a fluid flow path 24 within the flow duct 12 over which a primary flow of fluid 26 may flow. FIG. 4 shows a top view of the fluid mixing device 10 of FIG. 1 with the deployable and retractable projections 18 in deployed positions extending out of the gaps 20 in the inner surface 16 toward an inner portion 28 of the flow duct 12. The projections 18 may be deployed out of the gaps 20 in the inner surface 16 using a motor, a solenoid, or other mechanism known in the art. In this configuration, the projections 18 interrupt the otherwise smooth inner surface 16 of wall 14. As a result, a plurality of secondary fluid flows 30 (or secondary fluid flow vortices) are controllably formed (or generated) adjacent the inner surface 16 in each lobe 32 of the clover-leaf-shaped flow duct 12. In other embodiments, any number of secondary fluid flows 30 may be formed by using a varied number of projections 18. For instance, in one embodiment, only one secondary fluid flow 30 may be generated by using only one projection 18. In yet another embodiment, at least one secondary fluid flow 30 may be generated by using at least one projection 18. In still another embodiment, a coating may be applied to one or more of the projections 18 to at least partially impede the formation of one or more secondary fluid flows 30. The coating may be adapted to dissipate during a predetermined phase of use of the mixing device 10 to enable the projections 18 to form one or more secondary flows 30.

The secondary fluid flows 30 provide a significant advantage in that they promote mixing of the fluid flowing within the flow duct 12. Essentially, each secondary fluid flow vortex 30 operates to constantly bring fluid from the inner surface 16 of the wall 14 of the duct 12 to inner portion 28 of the flow duct 12 along one bi-sector, and from the inner portion 28 of the flow duct 12 towards the wall 14 of the duct 12 along the other bi-sector. Thus, fluid in each of the lobes 32 is well-mixed because of the secondary fluid flow vortices 30, which supplement the mixing of fluid provided by the primary fluid flow 26. The larger the size of the projections 18, and the farther they are each deployed out from the inner surface 16 of wall 14 towards the inner portion 28 of the flow duct 12, the more mixing of fluid will result.

Figure 5:
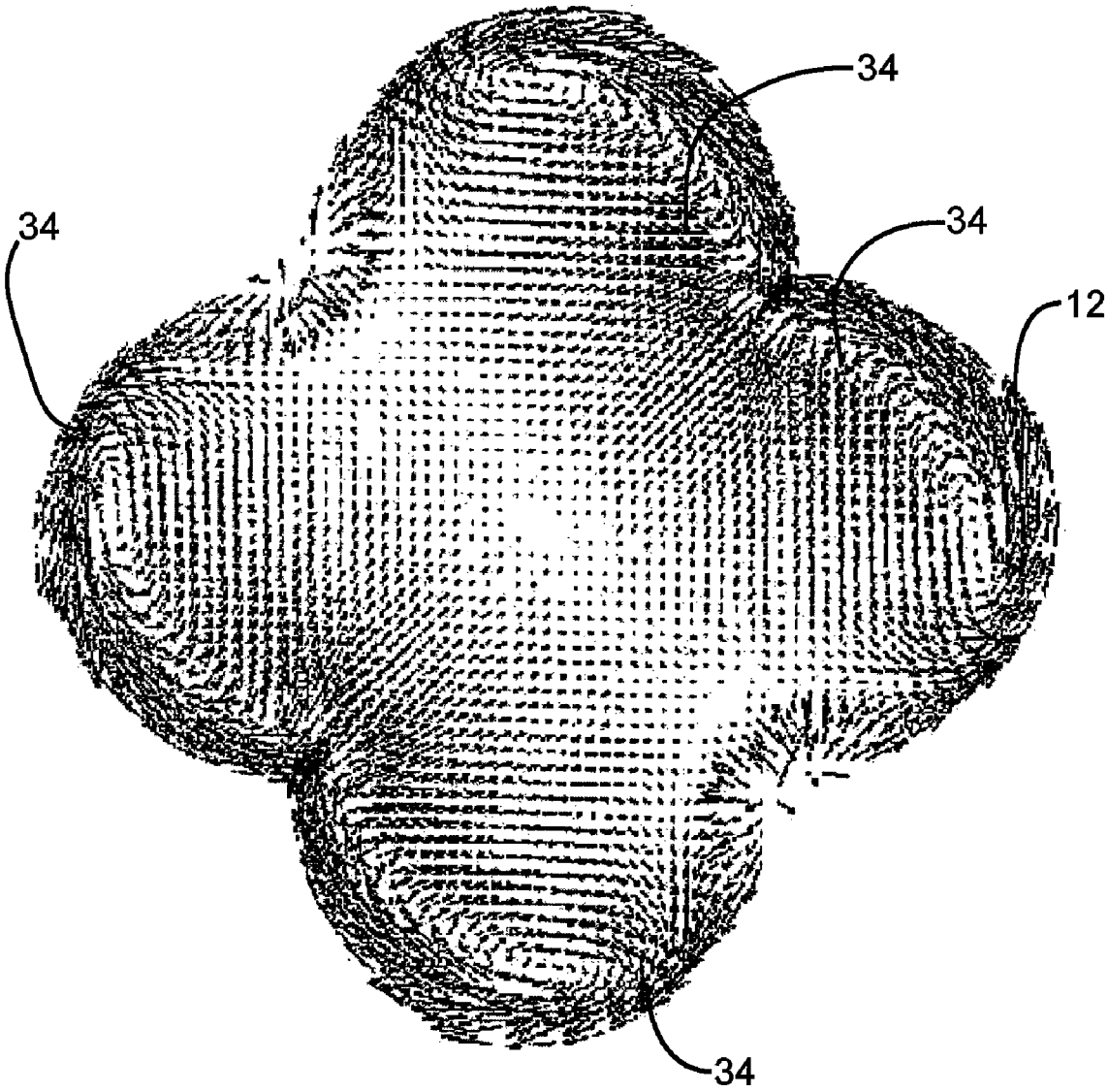
FIG. 5 shows the velocity vectors which result from flowing fluid within the flow duct of the embodiment of FIG. 4 while the projections are fully deployed.

FIG. 5 shows the velocity vectors which result from flowing fluid within the flow duct 12 of the embodiment of FIG. 4 while the projections 18 are fully deployed out of gaps 20 towards the inner portion 28 of the flow duct 12. In this embodiment, the projections 18 are helical vanes with 0.5 inch heights extending at 45 degree pitches relative to a longitudinal axis extending through the flow duct 12. However, in other embodiments, the projections 18 may be in a wide range of numbers, materials, pitches, configurations, sizes, and orientations. For instance, in one embodiment, the projections 18 may extend at an angle in the range of 0 to 90 degrees relative to a longitudinal axis of the flow duct 12. The darkened areas 34 in FIG. 5 signify the strong secondary fluid flows 30 in each of the lobes 32 which are generated by the fully deployed helical projections 18. If larger sized projections 18 are used, there will be higher strength secondary flows 30. Conversely, if small sized projections 18 are used, there will be lower strength secondary flows. Similarly, the lesser the projections 18 are deployed out of the gaps 20 towards the inner portion 28 of the flow duct 12, the lower will be the strength of the secondary flows 30.

One or more of a number, type, material, size, pitch, orientation, and configuration of the deployable and retractable projections 18 may be pre-determined based on a desired amount of fluid mixing within the duct 12. At different stages of a mixing process, the projections 18 may be deployed out towards the inner portion 28 of the flow duct 12 more than at other times of the mixing process in order to provide varying mixing of the fluid at different times. At other stages of a mixing process, some of the projections 18 in some of the lobes 32 of the duct 12 may be deployed varying amounts than other projections 18 in other lobes 32 of the duct 12 in order to provide stronger secondary flows 30 and more fluid mixing in some lobes 32 than in other lobes 32. At further stages of a mixing process, the projections 18 in the lobes 32 of the duct 12 may be deployed uniformly in the same amounts out towards the inner portion 28 of the flow duct 12.

Figure 6:
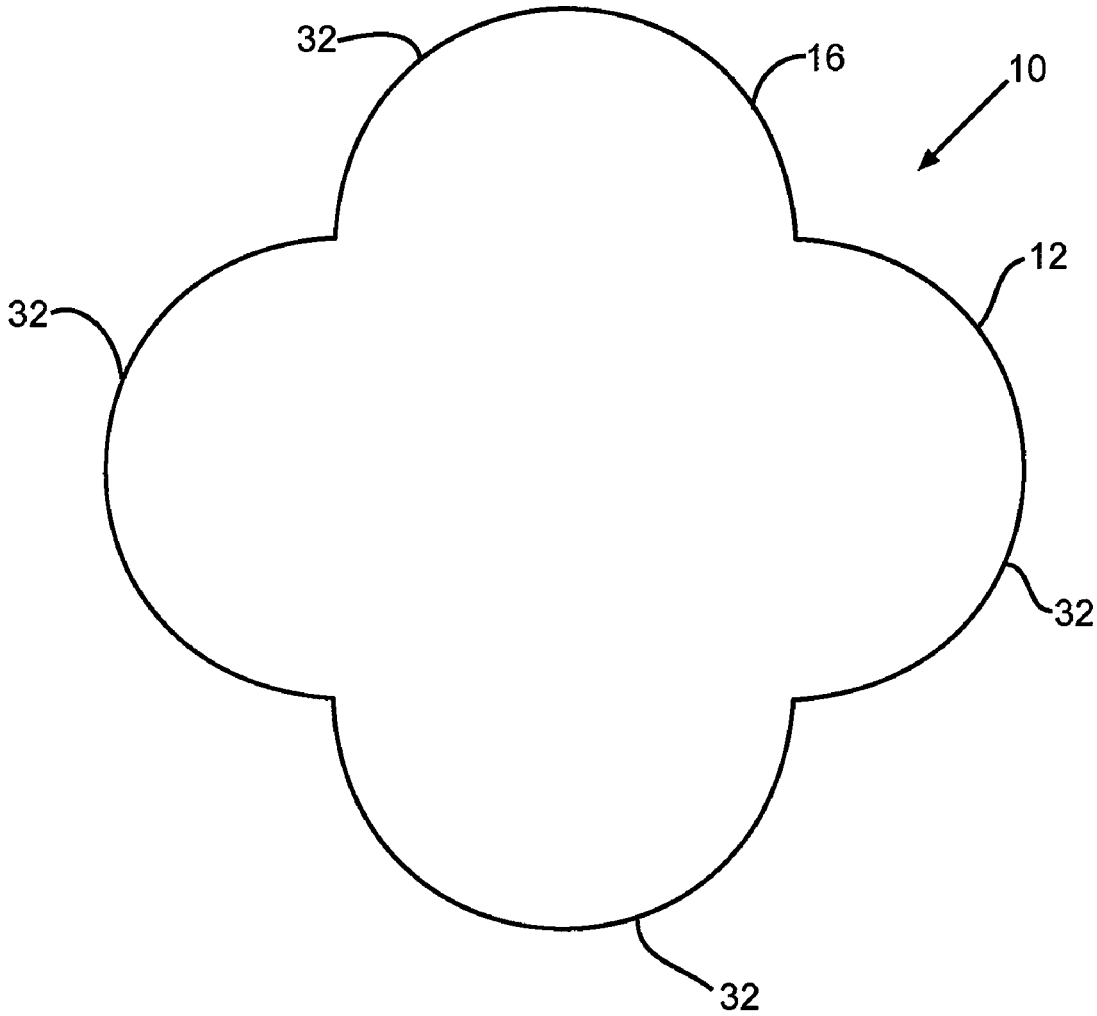
FIG. 6 shows a top view of the fluid mixing device of FIG. 1 with the deployable and retractable projections in retracted positions.

FIG. 6 shows a top view of the fluid mixing device 10 of FIG. 1 with the deployable and retractable projections 18 in retracted positions completely within the gaps 20 in the inner surface 16 of the flow duct 12. The projections 18 may have been retracted within the gaps 20 in the inner surface 16 using a motor, a solenoid, or other mechanisms known in the art. In this configuration, the projections 18 are stowed within the gaps 20 in the inner surface 16 in order to provide a generally smooth inner surface 16 of wall 14 which largely, if not completely, reduces and/or eliminates secondary fluid flows 30 within the flow duct 12. In this configuration, the main, and in some embodiments only, fluid flow within the duct 12 is the primary fluid flow 26.

Figure 7:
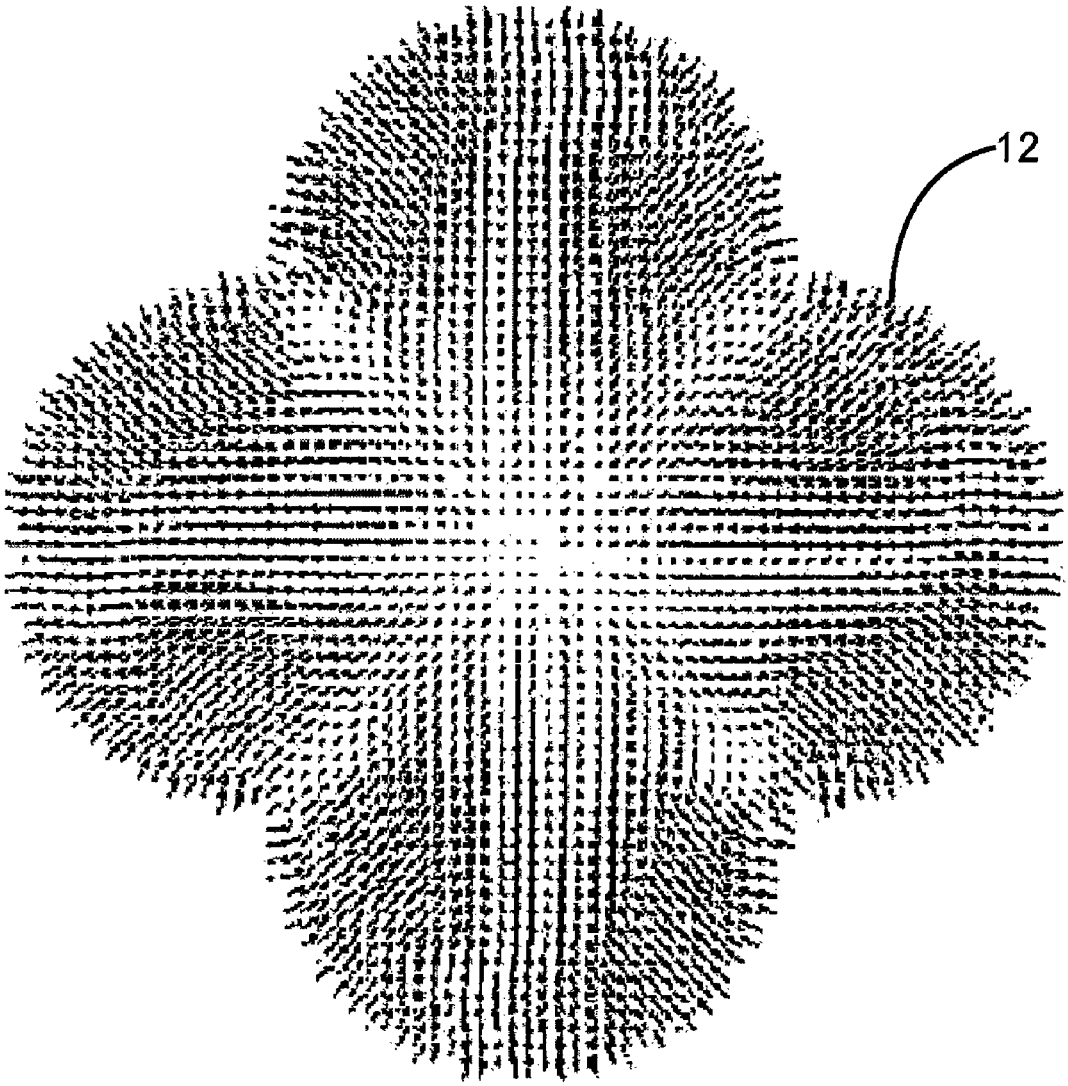
FIG. 7 shows the velocity vectors which result from flowing fluid within the flow duct of the embodiment of FIG. 6 while the projections are fully retracted.

FIG. 7 shows the velocity vectors which result from flowing fluid within the flow duct 12 of the embodiment of FIG. 6 while the projections 18 are fully retracted within the gaps 20 in the inner surface 16 of the flow duct 12. The lack of darkened areas 34 signifies the lack of secondary fluid flows 30.

Figure 8:
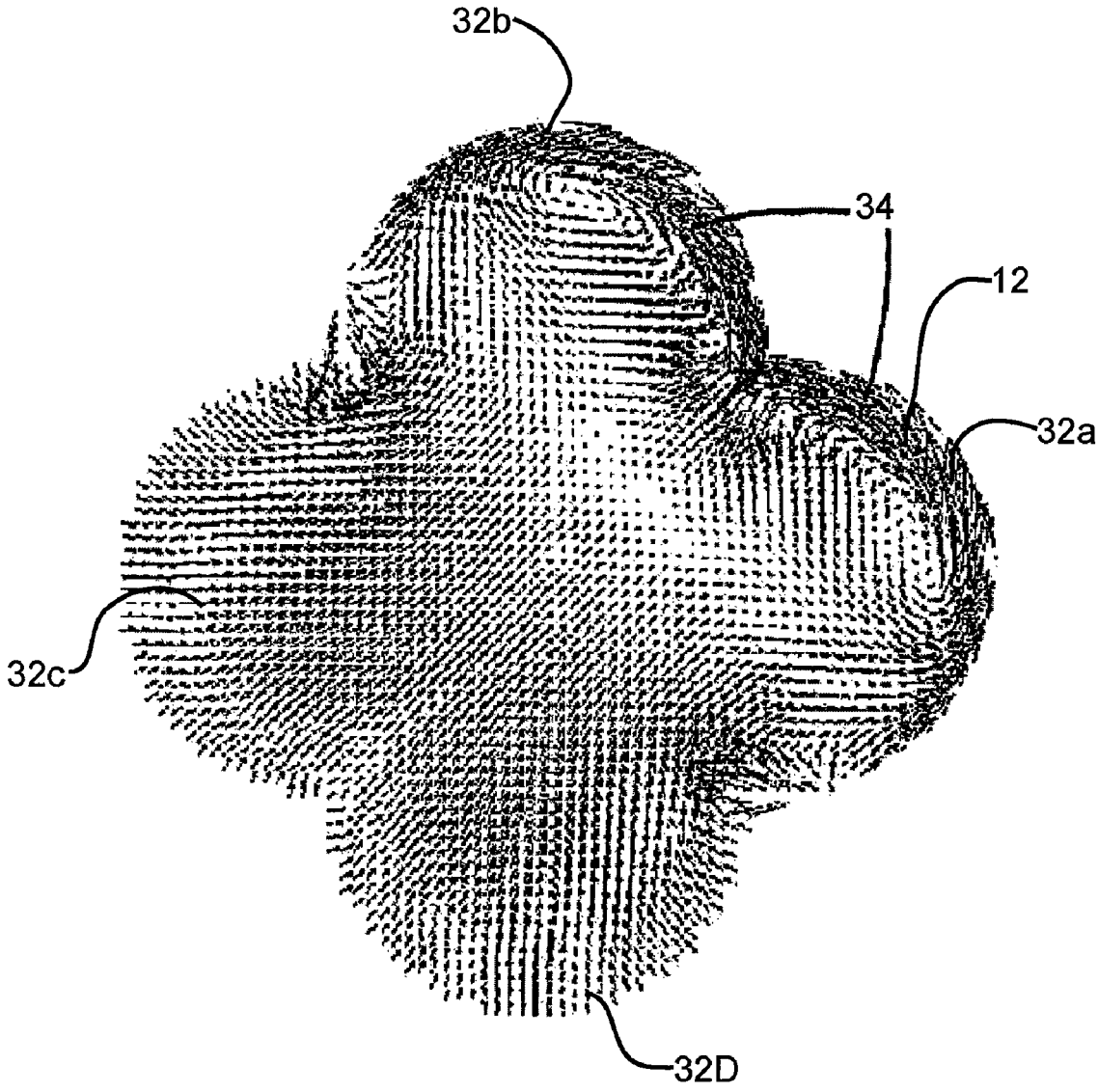
FIG. 8 shows the velocity vectors which result from flowing fluid within one embodiment of a clover-leafed flow duct with projections in some lobes fully deployed, and with projections in other lobes fully retracted.

At other stages of a mixing process, the projections 18 may be retracted only part-way within the gaps 20 of the inner surface 16 in order to provide an intermediary amount of secondary fluid flow 30 within the flow duct 12, in order to provide an intermediary amount of fluid mixing. In such manner, the amount of mixing of fluid within the flow duct 12 may be further controlled. In other stages of a mixing process, some of the projections 18 may be completely retracted within some of the gaps 20 of the lobes 32, while other of the projections 18 may be completely deployed, or only partly retracted, in other lobes 32 in order to provide varied secondary flows 30 and mixing within different lobes 32 of the clover-leaf shaped duct 12. For instance, FIG. 8 shows the velocity vectors which result from flowing fluid within a clover-leafed flow duct 12 with the projections 18 in lobes 32*a* and 32*b* fully deployed from the gaps 20 in the inner surface 16 of the flow duct 12, and with the projections 18 in lobes 32*c* and 32*d* fully retracted within the gaps 20 in the inner surface 16 of the flow duct 12. As shown, the darkened areas 34 within lobes 32*a* and 32*b* signify strong secondary fluid flows 30, while the lack of darkened areas 34 in lobes 32*c* and 32*d* signify the lack of secondary fluid flows 30. In additional stages of a mixing process, all of the projections 18 in all of the lobes 32 of the duct 12 may be deployed and/or retracted in uniform amounts to provide uniform mixing within the various lobes 32 of the duct 12. As detailed, by deploying and retracting the projections 18 in varying amounts, individually or collectively, varied secondary flows 30 may be controllably generated in the lobes 32 adjacent the inner surface 18 of the flow duct 12.

Figure 9:
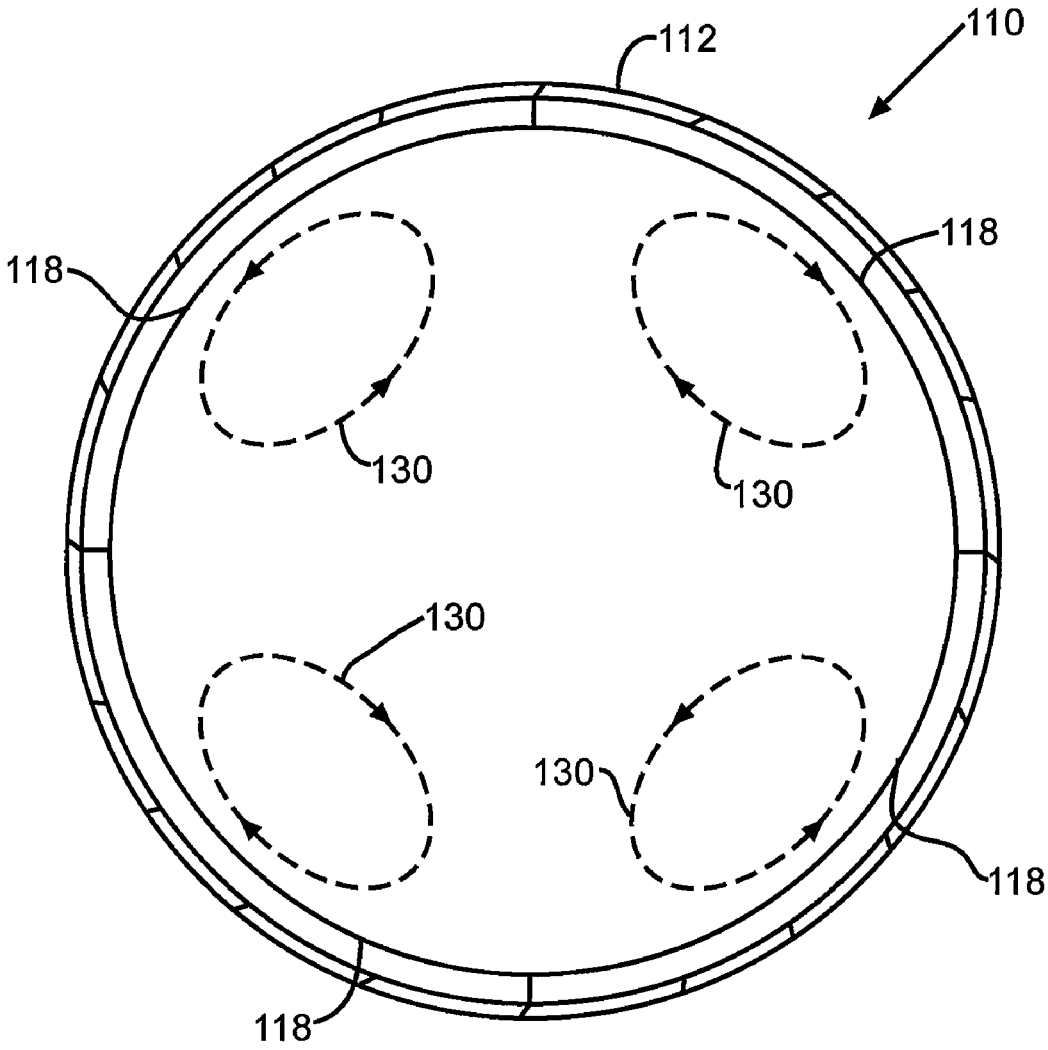
FIG. 9 shows a top view of another embodiment of a fluid mixing device.

FIG. 9 shows a top view of another fluid mixing device 110 having a flow duct 112 with a circular shape. When helical projections 118 are fully deployed within the flow duct 112, a plurality of secondary fluid flows 130 are formed around the flow duct 112. In other embodiments, varied shape projections 118 and fluid mixing devices 110 may be utilized in order to controllably generate secondary fluid flows 130.

Figure 10:
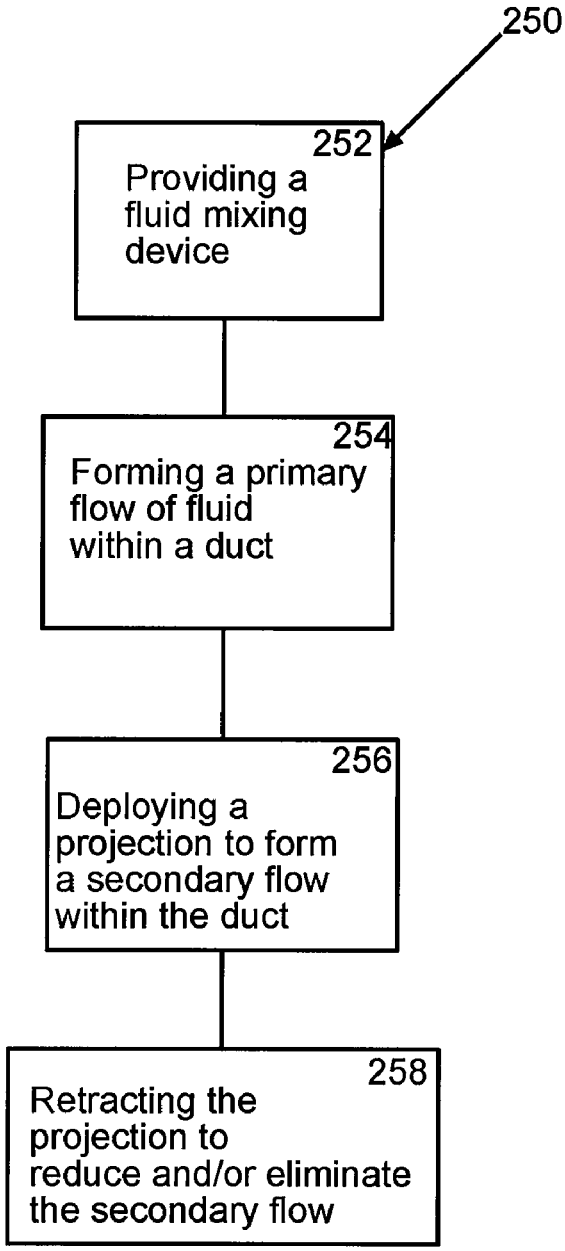
FIG. 10 is a flowchart showing one embodiment of a method for controllably mixing at least one fluid with a fluid mixing device.

FIG. 10 shows a flowchart of one embodiment 250 of a method for controllably mixing at least one fluid with a fluid mixing device 10. In one step 252, a fluid mixing device 10 is provided. The fluid mixing device 10 may comprise a duct 12 and at least one deployable and retractable projection 18, which may comprise only one projection 18 or a plurality of projections 18. In another step 254, a primary flow 26 of at least one fluid may be formed within the duct 18. In one embodiment, only one fluid may be used. In other embodiments, a plurality of fluids may be mixed. In still another step 256, the at least one deployable and retractable projection 18 may be deployed to form at least one secondary flow 30 within the duct 12 in order to controllably mix the at least one fluid within the duct 12. This may comprise deploying the at least one projection 18 from at least one gap 20 of an inner surface 16 of the duct 18. In one embodiment, only one projection 18 may be deployed and only one secondary flow 30 may be formed. In another embodiment, a plurality of projections 18 may be deployed and a plurality of secondary flows 30 may be formed. In yet another embodiment, a plurality of projections 18 may be deployed varying amounts in order to form a plurality of varying strength secondary flows 30.

The fluid mixing device 10, duct 12, and projections 18 may comprise any of the embodiments disclosed in this specification. In another step 258, the at least one projection 18 may be retracted to at least one of reduce and eliminate at least one secondary flow 30 within the duct 12. This may be achieved by retracting the at least one projection 18 into a gap 20 in the inner surface 16 of the duct 12. In one embodiment, one projection 18 may be retracted to reduce and/or eliminate one secondary flow 30. In another embodiment, a plurality of projections 18 may be retracted to reduce and/or eliminate a plurality of secondary flows 30. In still another embodiment, a plurality of projections 18 may be retracted varying amounts in order to produce a plurality of varying strength secondary flows 30 at varying locations within the duct 12. In yet another embodiment, during the steps of deploying 256 and retracting 258 the at least one projection 18, the amounts of deployment and/or retraction may be determined based on a desired amount of fluid mixing within the duct 12.

In another embodiment, a mixed fluid may be provided. The mixed fluid may have been mixed by forming a primary flow 26 of one or more fluids within a flow duct 12, and by deploying one or more deployable and retractable projections 18, of uniform or varying amounts, within the duct 12. In such manner, one or more uniform or varying strength secondary flows 30 may have been created within the duct 12 during the mixing. Any of the embodiments disclosed herein may have been used during the mixing of the fluid.

It should be understood, of course, that the foregoing relates to exemplary embodiments of the disclosure and that modifications may be made without departing from the spirit and scope of the disclosure as set forth in the following claims.

The invention claimed is:

1. A fluid mixing device comprising:

a flow duct extending lengthwise along a longitudinal axis, the flow duct having a perimeter extending transversely to and around the longitudinal axis, the flow duct configured to provide a primary flow flowing along the longitudinal axis; and at least one deployable and retractable projection disposed within the flow duct at an angle which is non-perpendicular and non-parallel to the longitudinal axis and configured to, when deployed in a direction away from at least one wall of the flow duct, provide at least one secondary flow flowing transversely to the primary flow, the at least one secondary flow configured to bring fluid from the at least one wall of the flow duct to an inner portion, disposed apart from the at least one wall, of the flow duct and back from the inner portion of the flow duct towards the at least one wall of the flow duct.

2. The fluid mixing device of claim 1, wherein when the at least one projection is deployed in the direction away from the at least one wall, the at least one projection extends from said at least one wall towards the inner portion of said flow duct and controllably generates the at least one secondary flow, wherein a flow rate of the at least one secondary flow is substantially zero when the at least one projection is completely retracted against or within said at least one wall so that it does not project out of the at least one wall, and the flow rate of the at least one secondary flow increases the more the at least one projection is deployed in the direction away from said at least one wall.

3. The fluid mixing device of claim 1, wherein when the at least one projection is deployed in the direction away from the at least one wall, the at least one projection extends from at least one gap in said at least one wall towards the inner portion of said flow duct.

4. The fluid mixing device of claim 1, wherein the angle is greater than 0 and less than 90 degrees.

5. The fluid mixing device of claim 3, wherein when the at least one projection is retracted in a second direction towards the at least one wall, the at least one projection is configured to be substantially retained within the at least one gap in said at least one wall to reduce or eliminate the at least one secondary flow.

6. The fluid mixing device of claim 1, wherein said at least one deployable and retractable projection comprises at least one vane.

7. The fluid mixing device of claim 6, wherein said at least one vane extends in a helical path around the perimeter of the flow duct.

8. The fluid mixing device of claim 1, wherein the fluid mixing device comprises a plurality of deployable and retractable projections disposed around the perimeter of the flow duct and configured to, when deployed in directions away from the at least one wall of the flow duct, provide a plurality of secondary flows flowing transversely to the primary flow.

9. The fluid mixing device of claim 8, wherein said plurality of deployable and retractable projections are adapted to each individually be deployed away from the at least one wall and retracted towards the at least one wall, using at least one moving device for moving the deployable and retractable projections, in varying amounts in order to separately controllably generate flow rates of the plurality of secondary flows flowing transversely to the primary flow, with the separate flow rate of each secondary flow increasing the more the associated deployable and retractable projection is deployed in the direction away from said at least one wall.

10. The fluid mixing device of claim 8, wherein said plurality of deployable and retractable projections comprise a plurality of vanes arranged in a helical pattern around the perimeter of the flow duct.

11. The fluid mixing device of claim 8 wherein the plurality of deployable and retractable projections are oriented at differing locations and orientations around the perimeter of the flow duct.

12. The fluid mixing device of claim 11 wherein the plurality of deployable and retractable projections are configured to, when deployed in the directions away from the at least one wall of the flow duct, provide a first secondary flow having a clockwise direction and provide a second secondary flow having a counterclockwise direction.

13. The fluid mixing device of claim 12 wherein the plurality of deployable and retractable projections are configured to, when deployed in the directions away from the at least one wall of the flow duct, provide, in a orientations transverse to the longitudinal axis, the first secondary flow having the clockwise direction and the second secondary flow having the counterclockwise direction.

14. The fluid mixing device of claim 11 wherein the plurality of deployable and retractable projections are configured to, when deployed in the directions away from the at least one wall of the flow duct, provide first and second secondary flows having clockwise directions.

15. The fluid mixing device of claim 14 wherein the plurality of deployable and retractable projections are configured to, when deployed in the directions away from the at least one wall of the flow duct, provide, in orientations transverse to the longitudinal axis the first and second secondary flows.

16. The fluid mixing device of claim 11 wherein the plurality of deployable and retractable projections are configured to, when deployed in the directions away from the at least one wall of the flow duct, provide first and second secondary flows having clockwise directions and provide third and fourth secondary flows having counterclockwise directions.

17. The fluid mixing device of claim 16 wherein the plurality of deployable and retractable projections are configured to, when deployed in the directions away from the at least one wall of the flow duct, provide, in orientations transverse to the longitudinal axis, the first and second secondary flows having the clockwise directions and the third and fourth secondary flows having the counterclockwise directions.

18. The fluid mixing device of claim 1, wherein said flow duct has a clover-leaf shape having separate lobes, and a plurality of deployable and retractable projections are disposed in the lobes around the perimeter of the flow duct.

19. The fluid mixing device of claim 1 further comprising a plurality of axially spaced deployable and retractable projections arranged circumferentially around an inner surface of said at least one wall of said flow duct.

20. The fluid mixing device of claim 1, wherein said at least one deployable and retractable projection is connected to at least one of a motor or a solenoid for controlling deployment of said at least one deployable and retractable projection away from the at least one wall of said flow duct and for controlling retraction of said at least one deployable and retractable projection towards the at least one wall of said flow duct.

21. A fluid mixing device comprising:

a flow duct extending lengthwise along a longitudinal axis, the flow duct having a perimeter extending transversely to and around the longitudinal axis, the flow duct configured to provide a primary flow flowing along the longitudinal axis; and a plurality of deployable and retractable projections disposed around the perimeter of the flow duct at at least one angle which is non-perpendicular and non-parallel to the longitudinal axis and configured to, when deployed in directions away from at least one wall of the flow duct, provide a plurality of secondary flows flowing transversely to the primary flow;

wherein at least one of the plurality of secondary flows operates to bring fluid from the at least one wall of the flow duct to an inner portion, disposed apart from the at least one wall, of the flow duct and back from the inner portion of the flow duct towards the at least one wall of the flow duct.

22. The fluid mixing device of claim 21 wherein the plurality of deployable and retractable projections are disposed in a helical formation around the perimeter of the flow duct.

23. The fluid mixing device of claim 21 further comprising at least one moving device for deploying the plurality of deployable and retractable projections away from the at least one wall of the flow duct, and for retracting the plurality of deployable and retractable projections towards the at least one wall of the flow duct.

24. The fluid mixing device of claim 23 wherein the at least one moving device is at least one of a motor or a solenoid.

25. The fluid mixing device of claim 23 wherein the plurality of deployable and retractable projections are each separately adapted to be retracted and deployed, using the at least one moving device, in varying amounts to provide the plurality of secondary flows with varying flow rates.

26. The fluid mixing device of claim 25 wherein when the plurality of deployable and retractable projections are retracted within gaps of the flow duct there are no secondary flows, and when the plurality of deployable and retractable projections are deployed in the directions away from the at least one wall of the flow duct, the plurality of secondary flows flow transversely to the primary flow with the flow rates of the secondary flows increasing as the plurality of deployable and retractable projections move farther away from the at least one wall of the flow duct.

27. The fluid mixing device of claim 21 wherein the plurality of deployable and retractable projections disposed around the perimeter of the flow duct are configured to, when deployed in the directions away from the at least one wall of the flow duct, provide first and second secondary flows flowing clockwise and transversely to the primary flow, and provide third and fourth secondary flows flowing counter-clockwise and transversely to the primary flow.

* * * * *